US005963756A

United States Patent [19]

Sakai et al.

[11] Patent Number: 5,963,756

[45] Date of Patent: Oct. 5, 1999

[54] COLOR CORRECTION IN A COLOR IMAGE FORMATION APPARATUS

[75] Inventors: Yoshihiko Sakai; Hiroyuki Hotta; Seigo Makida, all of Nakai-machi, Japan

[73] Assignee: Fuji Xerox Co., Ltd., Tokyo, Japan

[21] Appl. No.: 08/996,273

[22] Filed: Dec. 22, 1997

[30] Foreign Application Priority Data

Jan. 6, 1997 [JP] Japan ..... 9-000192

[51] Int. Cl.[6] ..... G03G 15/00; G03G 15/01

[52] U.S. Cl. ..... 399/39

[58] Field of Search ..... 399/39, 41, 72, 399/73, 74

[56] References Cited

U.S. PATENT DOCUMENTS

| | | | |
|---|---|---|---|
| 5,155,529 | 10/1992 | Rushing | 399/72 X |
| 5,298,943 | 3/1994 | Ide et al. | 399/39 |
| 5,325,153 | 6/1994 | Mitsuse et al. | 399/74 |
| 5,493,321 | 2/1996 | Zwadlo | 347/131 |
| 5,722,003 | 2/1998 | Suzuki et al. | 399/39 |

FOREIGN PATENT DOCUMENTS

| | | |
|---|---|---|
| A 62-296669 | 12/1987 | Japan . |
| A 63-185279 | 7/1988 | Japan . |
| A 1-169467 | 7/1989 | Japan . |
| A 5-199407 | 8/1993 | Japan . |
| A 5-333652 | 12/1993 | Japan . |
| A 6-30271 | 2/1994 | Japan . |
| A 6-171154 | 6/1994 | Japan . |
| A 6-186805 | 7/1994 | Japan . |
| A 9-171279 | 6/1997 | Japan . |

OTHER PUBLICATIONS

Alman, David H. et al. "Performance Testing of Color–Difference Metrics Using a Color Tolerance Dataset." *Color Research and Application,* vol. 14, No. 3, Jun. 1989, pp. 139–151.

*Primary Examiner*—Fred L. Braun
*Attorney, Agent, or Firm*—Oliff & Berridge, PLC

[57] ABSTRACT

When a color image is formed using exposure units, photoconductive drums, developing machines, transfer printing machines and the like, a color patch using each monochrome toner prepared for the above developing machines and a color patch formed by overlapping plural colors of toner are formed on a transfer medium as sample images. After the two types of color patches are fixed by a fixing roll, they are detected by a fixed image density sensor installed after the fixing roll. A control section corrects an image formation condition based upon difference in density between the two types of sample images.

12 Claims, 8 Drawing Sheets

COLOR CORRECTION IN A COLOR IMAGE FORMATION APPARATUS

BACKGROUND OF THE INVENTION

1. Field of the Invention

The present invention relates to a color image formation apparatus, particularly to a color image formation apparatus according to an electrophotographic method by which a high quality of image excellent in gray balance can be stably formed.

2. Description of the Related Art

To process color image information digitally and acquire an image for reproduction and other purposes, operations such as processing for decomposing an image in a color original into red-green-blue (RGB), reading it and converting it to color space according to L*a*b* system of color representation (L*: lightness, a*b*: hue and saturation) are executed. It is known that generally, man's sensitivity to color difference is extremely high.

As described in No. 3, vol. 14 of "Performance testing of color-difference metrics using a color tolerance dataset" written by D. H. Alman, R. S. Berns, G. D. Synder and W. A. Larsen and published in June, 1989 by COLOR research and application, if color difference ΔE between images to be compared is approximately 5 in an L*a*b* system of color representation, it can be identified regardless of an observer and a status, and if it is not to be recognized, a color difference between images has to be approximately 3. If the target level of the reproducibility of an image is set to a level exceeding the limit of man's recognition of color difference based upon the above fact, a value required for a color image formation apparatus is a very high value equivalent to the color difference of 3 or less.

However, as well-known, each process is instable in conventional type electrophotographic method and it is impossible to meet a high color difference value. This is because the electrophotographic method utilizes a phenomenon caused by static electricity, the image output state of an apparatus itself varies due to a service and environmental condition such as temperature and humidity and the aging and the like of photosensitive material and developer, and the reproducibility of an image fluctuates. In a color image formation apparatus using an electrophotographic method, feedback control is generally used to keep the density of an image suitable.

As a concrete example of feedback control, there is a method of calculating the set value correction amount of an actuator for control by determining an error between density in a density patch and target density,and multiplying it by a feedback gain so as to monitor a state in which density is reproduced as well as an environmental condition in an apparatus using a density patch. For example, in an image formation apparatus disclosed in Japanese Published Unexamined Patent Application No. Hei 1-169467, desired image density is acquired by measuring density in a density patch and controlling the conditions of exposure and developing bias. For a density patch, an unfixed toner image density patch after a developing process or a density patch of a fixed image formed on a transfer medium such as paper after a fixing process is used.

A reason why a toner image density patch is used is that a developed image can be more readily generated or erased than a transfer image or a fixed image created on paper. However, although a toner image density patch is closely related to fixed image density, the effect of variation in a transfer process which is a postprocess cannot be detected using the toner image density patch. In the meantime, a reason why a fixed image density patch is used is that the type of an image is an image itself which a user finally obtains and the quality of an image can be evaluated including the cause of variationin a transfer process and a fixing process.

An image formation apparatus monitoring fixed image density is disclosed in Japanese Published Unexamined Patent Applications No. Sho 62-296669, No. Sho 63-185279, No. Hei 5-199407 and others, and each case utilizes an image reader built in the body of each apparatus.

However, if an image reader is utilized, a user is required to send an image once output to the image reader and read it again so as to detect the image and it is very troublesome for the daily management of image quality. In the case of a color image formation apparatus not provided with an image reader such as a printer, an image cannot be detected in principle.

The applicant of the present invention proposes a color image formation apparatus for enabling monitoring an output image online after a fixing process in Japanese Patent Application No. Hei 7-332373. A sensor for monitoring a color image used in a color image output device in the above application uses the light emitting diodes (LED) of blue (B), green (G), and red (R) corresponding to each monochrome toner of yellow (Y), magenta (M), and cyan (C) as a light source and is constituted so that reflected light from an output image is received by a photodiode.

Generally, the band of the emission spectrum of LED is narrower than one of a spectrum by RGB filter, etc. and it is said to be difficult to divide all colors into a spectrum precisely. However, by limiting the conditions of use of a sensor with an LED light source forming an image output for a monitor as a color patch consisting of monochrome toner such as Y, M, and C and detecting the quantity in which each monochrome toner adheres, that is, the density of each toner, a sensor for a monitor can be provided which is by far more advantageous in cost and size than a conventional type color sensor which divides all colors into a spectrum and identifies each of full colors and is necessary and sufficient in performance. As described above, the reproducibility of the quality of each monochrome toner image can be enhanced by detecting the density of monochrome toner and controlling image formation conditions.

In the meantime, a normal full color image is seldom formed by only individual monchrome toner. Rather an image is formed by overlapping plural types of color toner. However, as transfer efficiency varies depending upon environment in an apparatus such as temperature and humidity, the transfer order of each toner and the like in the above overlapping process, that is, in a transfer process, the transfer efficiency of monochrome toner and that of overlapped color toner, may not coincide. As a result, even if the reproducibility of the quality of each monochrome toner image is excellent, a target image quality cannot be reproduced in a full color image in which plural types of color toner are overlapped simply because of that. Therefore, it is verified that it is difficult to acquire neutral gray, that is, gray balance reproduced by three primary colors of Y, M, and C.

A color image formation apparatus disclosed in Japanese Published Unexamined Patent Applications No. Hei 5-333652, No. Hei 6-30271, No. Hei 6-171154 and others relates to the fluctuation of the above transfer efficiency. In these apparatuses, image quality control in consideration of effect by the fluctuation of transfer efficiency is executed by detecting not only the density of a toner image after development, that is, before transfer, but also the density of a toner image after transfer and calculating the transfer efficiency based upon the ratio between them of the density.

However, a color image formation apparatus which detects the density of a toner image before and after transfer requires at least two toner image density sensors for every color. For example, in the case of a color image formation apparatus provided with an image formation unit every color of yellow (Y), magenta (M), cyan (C), and black (BK) requires maximum eight (four colors x two units) toner image density sensors and there arises a problem in the size and cost. As infrared rays are normally used for the light source of a toner image density sensor, each color toner of Y, M, and C cannot be identified. Therefore, in the case of an image in which plural types of toner is overlapped, it is extremely difficult to identify and detect the density of a monochrome toner image after transfer and precise gray balance cannot be acquired. In Japanese Published Unexamined Patent Application No. Hei 6-186805, a color image formation apparatus which detects the density of each color toner image using a color sensor on the market is disclosed. However, if the density of each color toner image is detected using a color sensor on the market, light emitted from a light source is scattered when the light transmits the unfixedtoner layer of each color for forming an image. Therefore, reflected light provided with a spectrum reflected by a toner layer on the surface of a photoconductive drum fully occpies a spectrum detected by a sensor based upon reflection.

Therefore, it is also extremely difficult to identify the color of toner except the surface layer based upon an unfixed toner image by a sensor such as a color sensor using not infrared rays but light which can be divided into a spectrum and precise gray balance cannot be acquired. Further, it is impossible in principle for a toner image density sensor to detect an image after a fixing process which is an output image that a user finally obtains.

SUMMARY OF THE INVENTION

Therefore, one object of the present invention is to provide a color image formation apparatus wherein the precision of gray balance in a full color image formed by overlapping plural toner colors can be enhanced.

Another object of the present invention is to provide a color image formation apparatus wherein fluctuation of the transfer efficiency of color toner can be suitably corrected while maintaining cost reduction and miniaturization of size.

Further, another object of the present invention is to provide a color image formation apparatus wherein the density of each color in a color patch in which colors are overlapped can be precisely detected individually.

To achieve the above objects, the present invention provides a color image formation apparatus provided with image formation means for forming a color image under color image formation conditions, detection means for detecting the color density of the above color image, and control means for correcting the above formation conditions according to the above color density detected by the above detection means as a first characteristic for detecting the color density of a color image formed under set formation conditions of a color image and correcting the above formation conditions according to the color density wherein the above image formation means forms a first sample image using at least one of plural color materials for forming a color image independently and a second sample image in which plural color materials are overlapped, the above detection means is provided with a light source for radiating each detecting light of red, green and blue on the above first and second sample images and a light receiving section for receiving the reflected light or the transmitted light according to the density of the first and second sample images of the above detecting light, and the above control means corrects the above formation conditions according to the difference between the color density of colors respectively corresponding to the first and second sample images.

Further, to achieve the above objects, the present invention provides a color image formation apparatus provided with image formation means for forming a color image under color image formation conditions, detection means for detecting the color density of the above color image, and control means for correcting the above formation conditions according to the above color density detected by the above detection means as a second characteristic for detecting the color density of a color image formed under set formation conditions of a color image and correcting the above formation conditions according to the color density wherein the above image formation means forms a first sample image using at least one of plural color materials for forming a color image independently and a second sample image in which plural color materials are overlapped, the above detection means is provided with a light source for radiating each detecting light of red, green, and blue on the above first and second sample images and a light receiving section for receiving the reflected light or the transmitted light according to the density of the first and second sample images of the above detecting light, and the above control means corrects the above formation conditions according to the difference between the color density of the first sample image and the target value and corrects the above formation conditions according to the difference between the color density of colors respectively corresponding to the first and second sample images.

DESCRIPTION OF THE PREFERRED EMBODIMENT

Figure 1:
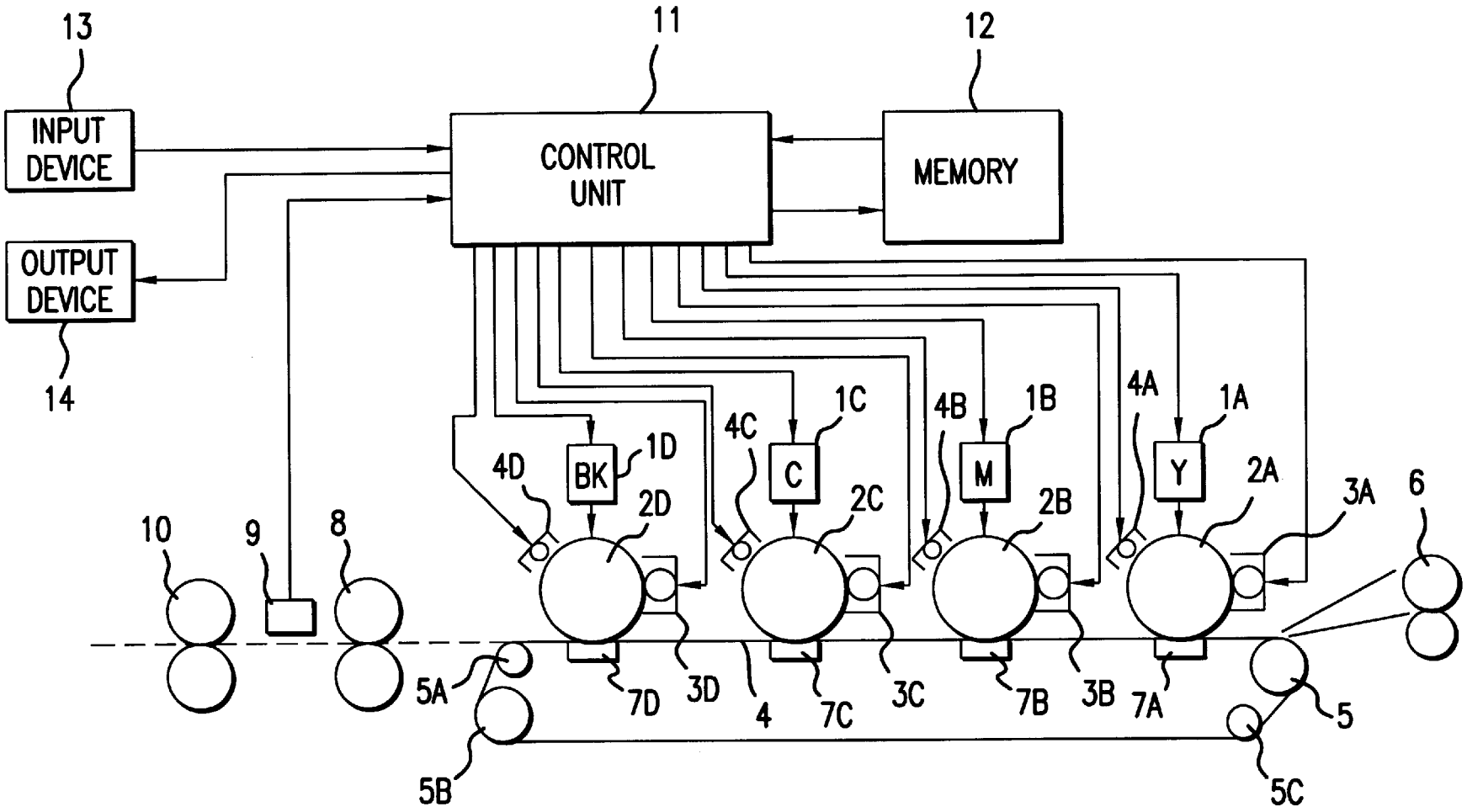
FIG. 1 is a block diagram showing a color image formation apparatus equivalent to an embodiment of the present invention.

FIG. 1 shows a color image formation apparatus equivalent to an embodiment of the present invention. The color image formation apparatus is constituted by: exposure units 1A to 1D provided with a laser beam source (not shown) for radiating a laser beam modulated based upon the image data of Y, M, C, and BK acquired by processing the color data of R, G, and B, a rotary polygon mirror (not shown) for deflecting the radiated laser beam and the like; photoconductive drums 2A to 2D respectively electrified by chargers 4A, 4D, on each surface of which an electrostatic latent image is formed. While photoelectric drum is being rotated, by receiving a laser beam from the respective exposure unit 1A to 1D; developing machines 3A to 3D for developing the electrostatic latent image formed on each surface of the photoconductive drums 2A to 2D by each color toner of Y, M, C, and BK; a transfer belt 4 for carrying a transfer medium such as plain paper or a plastic sheet (hereinafter called "transfer sheet") and opposing it to each of the photoconductive drums 2A to 2D in order; a driving roll 5 for turning the transfer belt 4, guiding it by follower rolls 5A to 5D; a registration roll 6 for loading the transfer sheet onto the transfer belt 4 from before the photoconductive drum 2A at a predetermined timing; transfer printing machines 7A to 7D respectively opposite to the photoconductive drums 2A to 2D with the transfer belt 4 between each photoconductive drum and each transfer printing machine for transferring a toner image on each photoconductive drum 2A to 2D on the surface of the transfer sheet, a pair of upper and lower fixing rolls 8 for fixing the transfer image (the toner image) in which transfer is finished on the transfer sheet; a fixed image density sensor 9 arranged so that it is opposite to a predetermined position of the transfer sheet which passes between the fixing rolls; an ejection roll 10 for ejecting the transfer sheet which passes a position in which the fixed image density sensor 9 is installed outside the apparatus; a control unit 11 for controlling the exposure units 1A to 1D, the developing machines 3A to 3D and the chargers 4A to 4D based upon the result of detection by the fixed image density sensor 9; memory 12 for storing a program, data and the like required for the execution of control by the control unit 11; an input device 13 for inputting various data, instructions and the like to the control unit 11; and an output device 14 for displaying according to the result of control by the control unit 11.

Figure 2:
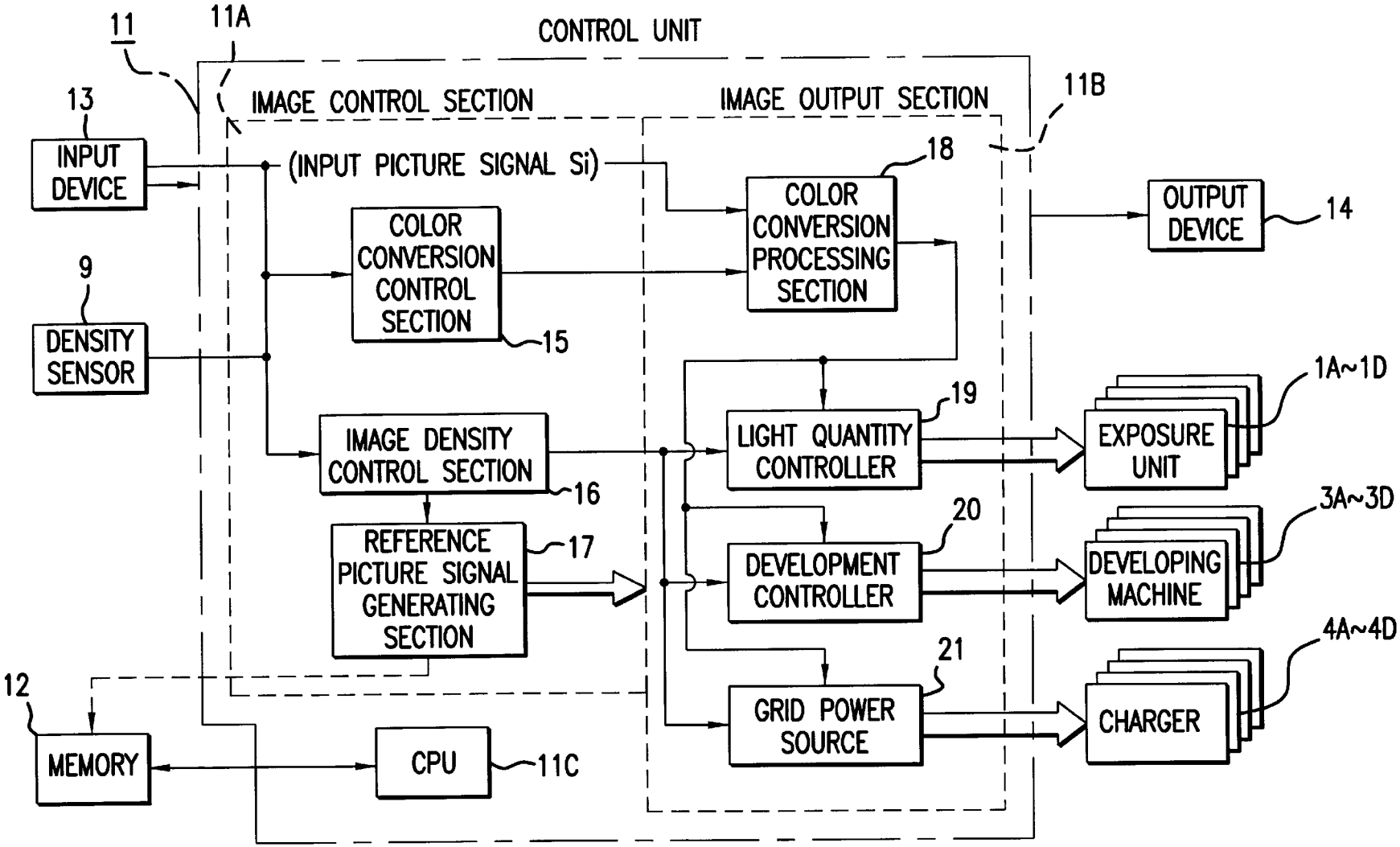
FIG. 2 is a block diagram showing the detailed constitution of a control section shown in FIG. 1.

FIG. 2 shows the detailed constitution of the control unit 11. The control unit 11 consists of an image control section 11A, an image output section 11B and CPU 11C. The image control section 11A is constituted by: a color conversion control section 15 for executing color conversion control based upon the result of detection by the fixed image density sensor 9; an image density control section 16 for executing the control of image density upon the controllers of the image output section 11B and a power source for electrification based upon the result of detection by the fixed image density sensor 9; and a reference picture signal generating section 17 for generating a signal for forming a sample image in a position detected by the fixed image density sensor 9.

As a color image formation apparatus using an electrophotographic method utilizes an electrostatic phenomenon, a state in which the apparatus outputs an image changes due to an environmental condition such as temperature and humidity or the aging of the photoconductive drum and a developer and a reproduced image is often influenced. As environmental conditions elapsed time and the number of output copies can be given in addition to temperature and humidity.

In the meantime, a user desires that whatever history an apparatus has and in whatever environment it is installed, the quality of an output image is always satisfactory. That is, an image formation apparatus is required to maintain the high quality of an image stably for a long term.

As described above, the state of an image formation apparatus according to the electrophotographic method changes due to the variation of environment and others every moment and to correct it in a short cycle, an image output state is required to be regularly monitored and controlled.

In the present invention, not only the density of each monochrome toner of Y, M, C, and BK is controlled but also the density of each color in a finally fixed color image formed by overlapping the above colors is controlled.

The embodiment of the present invention particularly corresponds to an effect which the variation of the above environmental condition has upon a transfer process. The transfer efficiency of each color of toner laminated on the photoconductive drum differs. It is because the farther a layer is from a first layer which is in contact with the photoconductive drum, the more easily it is influenced by environmental conditions. Therefore, the transfer efficiency of each color of toner laminated on the photoconductive drum is corrected according to the change of an environmental condition in addition to the transfer efficiency of monochrome toner. If the transfer efficiency of each color of toner in case two or three colors are overlapped is not suitably corrected, it is difficult to acquire a neutral gray reproduced by three primary colors of Y, M, and C, so-called gray balance, however, according to the constitution disclosed in this embodiment, excellent gray balance can be acquired even if some colors are overlapped.

The image density control section 16 shown in FIG. 2 is provided with color mixture correction means for correcting the transfer efficiency of each color of toner laminated on the photoconductive drum according to the change of an environmental condition in addition to the transfer efficiency of monochrome toner. The color mixture correction means receives a signal from a temperature sensor (temperature is an environmental condition), generates a control signal and respectively sends it to a light quantity controller 19, a development controller 20, and a grid power source 21 in response to a signal showing the difference between output acquired from a first color sample and output acquired from a second color sample.

The color mixture correction means is provided with a look-up table for every color for specifying a temperature value and a light quantity value in response to the above signal showing difference, a look-up table for every color for specifying a temperature value and a developing bias value in response to the above signal showing difference, and a look-up table every color for specifying a temperature value and a grid voltage value in response to the above signal showing difference. If the temperature value of a specific color and the above signal showing difference are determined, a color image control condition such as light quantity is determined. Such control is required for an image formation method which is readily influenced by the change of environment such as a color image formation apparatus using the electrophotographic method. No control upon color mixture is executed in another image output method under a condition which is hardly or never influenced by a change of environment.

The image output section 11B is constituted by a color conversion processing section 18 for executing color conversion processing such as processing for correcting the conversion coefficient of a color conversion matrix for an input picture signal $S_i$ based upon the output of the cover conversion control section 15; a light quantity controller 19 for controlling the exposure units 1A to 1D based upon output from the image density control section 16 and the color conversion processing section 18; a development controller 20 for controlling the developing machines 3A to 3D based upon output from the image density control section 16 and the color conversion processing section 18; and a grid power source 21 for controlling voltage applied to the chargers 4A to 4D based upon output from the image density control section 16 and the color conversion processing section 18. Further, CPU 11C is connected to the memory 12 and components via a bus (not shown) and executes control for image formation, display control and various other control.

Figure 3:
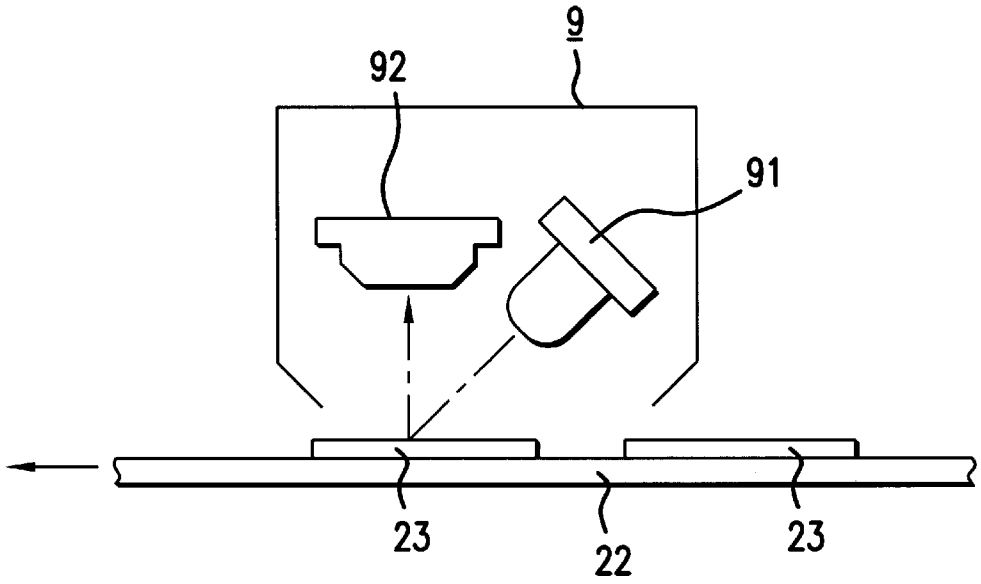
FIG. 3 is an explanatory drawing showing reading in a fixed image density sensor shown in FIG. 1.

FIG. 3 shows the schematic constitution of the fixed image density sensor 9, which and is constituted by a light emitting diode (LED) 91 for radiating light of a predetermined wavelength on the surface of a color patches 23 on a transfer sheet 22 (actually, there are plural light emitting diodes as described later) and a photodiode 92 for receiving reflected light from the surface of the color patches 23 on the transfer sheet 22 (actually, these are plural photodiodes as described later) The fixed image density sensor may be also designed so that the arrangement of the light emitting diode 91 and the photodiode 92 is inverted according to the superficial state of the patch.

Figure 4:
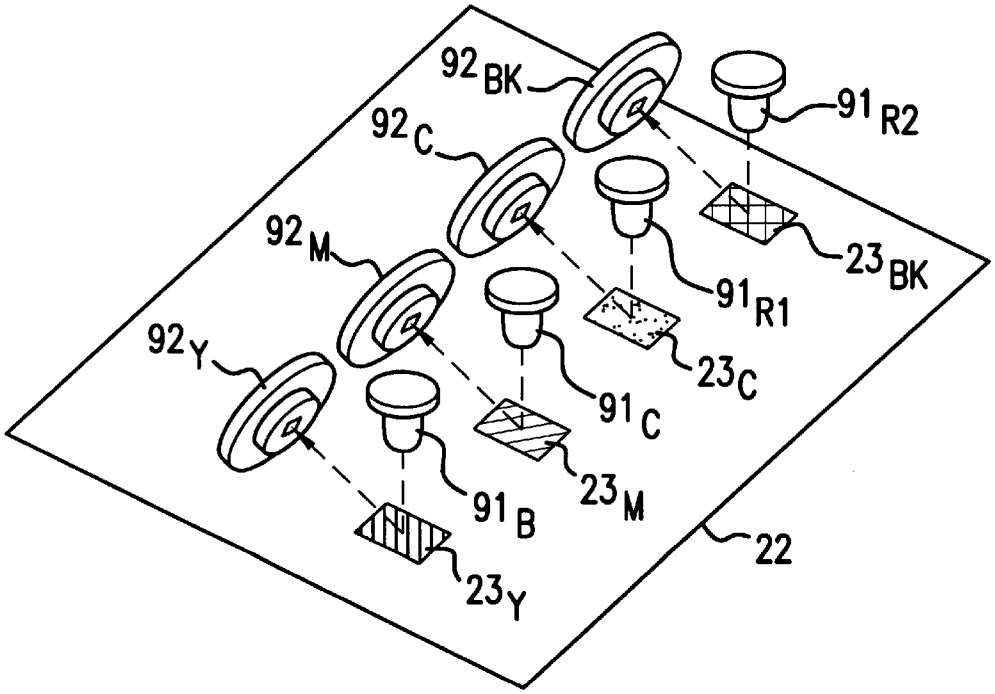
FIG. 4 is an explanatory drawing showing a state in which light emitting diodes and photodiodes of the fixed image density sensor according to the present invention are arranged.

FIG. 4 shows a state in which the light emitting diodes 91 and the photodiodes 92 of the fixed image density sensor 9 are arranged to detect the density of each monochrome toner. In FIG. 4, constitution in which the arrangement shown in FIG. 3 of the light emitting diode 91 and the photodiode 92 is inverted is adopted. On the transfer sheet 22, four square patches, that is, a yellow patch $\mathbf{23}_Y$, a magenta patch $\mathbf{23}_M$, a cyan patch $\mathbf{23}_C$, and a black patch $\mathbf{23}_{BK}$ are arranged as reference patterns at a predetermined interval in the cross direction. LED $\mathbf{91}_B$ for emitting blue light is arranged above the yellow patch $\mathbf{23}_Y$, LED $\mathbf{91}_G$ for emitting green light is arranged above the magenta patch $\mathbf{23}_M$, LED $\mathbf{91}_{R1}$ for emitting red light is arranged above the cyan patch $\mathbf{23}_C$, and LED $\mathbf{91}_{R2}$ for emitting red light is arranged above the black patch $\mathbf{23}_{BK}$. Further, the photodiode $\mathbf{92}_Y$ is arranged along the reflected light path of the LED $\mathbf{91}_Y$, the photodiode $\mathbf{92}_M$ is arranged along the reflected light path of LED $\mathbf{91}_M$, the photodiode $\mathbf{92}_C$ is arranged along the reflected light path of LED $\mathbf{91}_C$ and the photodiode $\mathbf{92}_{BK}$ is arranged along the reflected light path of LED $\mathbf{91}_{BK}$.

Figure 5A:
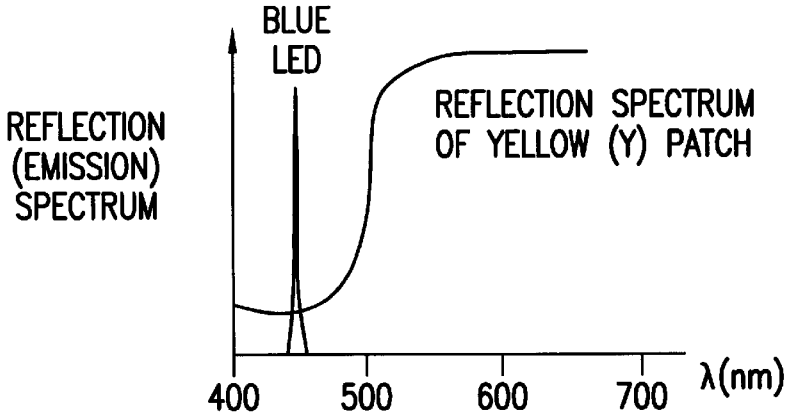
FIGS. 5(*a*)–5(*c*) are characteristic drawings showing the characteristics of the wavelength of light emitted by the light emitting diode in the fixed image density sensor according to the present invention and a reflection spectrum of each patch in Y, M, and C.
Figure 5B:
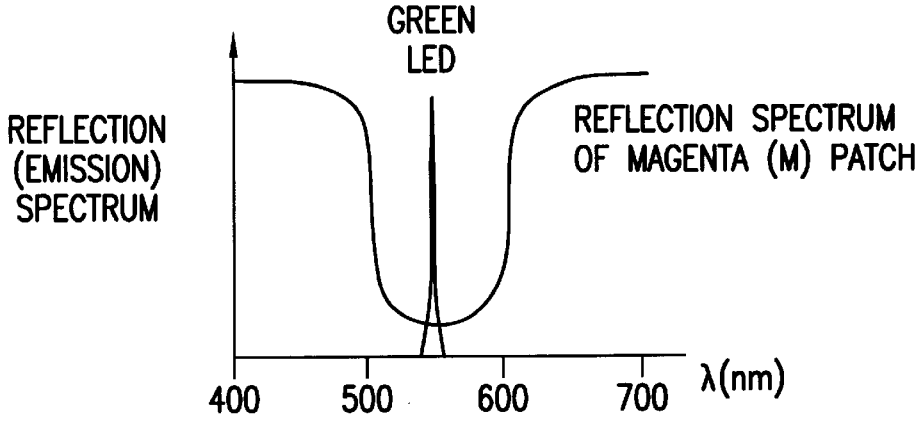
Figure 5C:
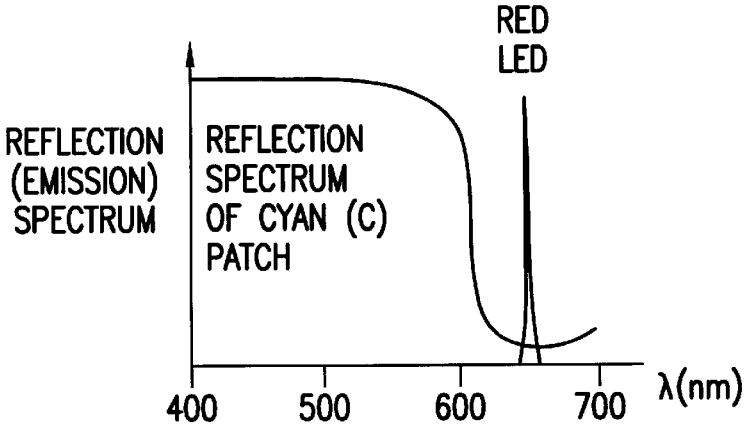

FIGS. 5(*a*), 5(*b*) and 5(*c*) show a reflection spectrum of each of the yellow patch $\mathbf{23}_Y$, the magenta patch $\mathbf{23}_M$, and the cyan patch $\mathbf{23}_C$ when the characteristics of the wavelength of light emitted from LEDs $\mathbf{91}_B$, $\mathbf{91}_G$, and $\mathbf{91}_{R1}$ ($\mathbf{91}_{R2}$) and LEDs $\mathbf{91}_B$, $\mathbf{91}_G$, and $\mathbf{91}_{R1}$ are used. The wavelength of emitted light of each color is short, the absorptivity is high in the vicinity of the wavelength of emitted light in a reflection spectrum of the yellow patch $\mathbf{23}_Y$ coupled with the blue LED $\mathbf{91}_B$ and a reflection factor is high in an area distant from the wavelength of emitted light. This is also similar when another patch is combined with another LED. In principle, any of blue, green, red, and white light sources may be used. In this embodiment, a red LED, of which the sensitivity of the corresponding light receiving element is high and which is relatively low-priced, is used.

As described above, the precision of detecting the color density of each monochrome toner can be enhanced by combining the color of light emitted from LED 91 with the complementary color of each monochrome toner in each patch, that is, respectively combining blue, green and red LEDs with yellow, magenta, and cyan toners.

When the temperature of the fixing roll 8 reaches a predetermined temperature by a built-in heater after the color image formation apparatus of the above constitution is turned on, a message that copying is enabled is displayed on the display of the output device 14. When an instruction to start copying is input from the input device 13 in this state, the photoconductive drums start to be rotated. Each surface of the photoconductive drums 2A to 2D is uniformly electrified by the corresponding chargers 4A to 4D in the process of rotation. An electrostatic latent image corresponding to an image which an input picture signal shows is formed on each electrified surface by the corresponding exposure units 1A to 1D under the control of the image control section 11A and the image output section 11B. Toner of the corresponding color from the corresponding developing machines 3A to 3D controlled by the development controller 20 is applied to the electrostatic latent image on each photoconductive drum 2A to 2D and a toner image is formed. The toner image is continuously formed together with the rotation of the respective photoconductive drums 2A to 2D.

In the meantime, the transfer belt 4 is turned with it interlocked with the photoconductive drums 2A to 2D, and a transfer sheet is sent from the registration roll 6 at a predetermined timing and carried to the lower surface of the photoconductive drum 2A using the transfer belt 4 as a carrying member. Toner images on the surface of the photoconductive drum 2A are transferred in order onto the transfer sheet by the transfer printing machine 7A. Similarly, toner images on each surface of the photoconductive drums 2B to 2D are transferred with the toner images overlapped on the transfer image already formed on the transfer sheet every time the transfer sheet is carried by the transfer belt 4 and a color image is formed. The transferred transfer sheet is carried to the fixing roll 8 and the transfer image is fixed on paper by heating and pressurization. Afterward, the transfer sheet is ejected to an ejection tray (not shown) outside the apparatus by the ejection roll 10. Toner left on the photoconductive drums 2A to 2D after transfer is removed from the surface of the drums by a cleaner (not shown).

Next, the operation when an instruction to correct a color is input via the input device 13 will be described. In the present invention, two types of color patches i.e., a color patch consisting of monochrome toner and a color patch in which plural types of toner are overlapped, are formed as sample images. First, to facilitate understanding, the reading of a sample image consisting of color patches consisting of monochrome toner will be described.

When an instruction to correct is issued, the instruction is transmitted to the reference picture signal generating section 17 via the image density control section 16 and a reference pattern signal generated by the reference picture signal generating section 17 is applied to the image output section 11B. The electrostatic latent image of a sample image according to the reference pattern signal is formed on each photoconductive drum 2A to 2D by the operation of the light quantity controller 19 and the exposure units 1A to 1D. Then, the electrostatic latent image is developed as described above and further, a color patch as the sample image is transferred on the transfer sheet 22. As a result, the yellow patch $\mathbf{23}_Y$, the magenta patch $\mathbf{23}_M$, the cyan patch $\mathbf{23}_C$ and the black patch $\mathbf{23}_{BK}$ respectively shown in FIG. 4 are formed on the transfer sheet 22. The recording paper 22 on which these color patches are transferred is fixed by the fixing roll 8 and then, passed immediately under the fixed image density sensor 9. In the process of the above passage, each color patch is read by the fixed image density sensor 9 as shown in FIGS. 3 and 4 and the result of the detection is input to the image control section 11A. The image density control section 16 compares the detected density of a fixed image with the density target value of a reference pattern fixed image stored in advance in the memory 12, grasps differences among the image formation conditions of each color toner, and according to the above status, the image output section 11B controls the light quantity controller 19, the development controller 20, the grid power source 21, etc. using electrifying voltage by each charger 4A to 4D, the quantity of exposure by each exposure unit 1A to 1D, the developing bias voltage of each developing machine 3A to 3D, the rotational speed of a developing roll in each developing machine 3A to 3D, a toner supply coefficient (the density of developer), and the manipulated variable of one or more of each manipulated variable such as the driving conditions of the transfer printing machines 7A to 7D (in this embodiment, the quantity of electrification and that of exposure). Thus, a desired image quality can be acquired.

As the density and the color information of a fixed image can be acquired by arranging the fixed image density sensor 9 after the fixing roll 8 as described above, image formation conditions can be corrected based upon a final image that a user obtains. As the fixed image density sensor 9 uses LED with a narrow in a spectrum band as a light source as described above, the fixed image density sensor can also identify each monochrome toner of Y, M, and C in a color patch in which plural types of toner are overlapped precisely as described later, compared with an RGB filter with a relatively wide spectrum band and the like, and can detect the quantity of each toner.

However, as described above, as there is a difference in a transfer efficiency between the following monochrome image and a full color image formed by overlapping plural types of toner, even if a desired image is acquired in a color patch consisting of monochrome toner, a desired image is not necessarily acquired. A cause of a difference in a transfer efficiency as described above is that already transferred toner layers exist except a first transferred toner layer on a transfer sheet to be transferred if multiple transfer is executed to form a color image and they have some effect such as the turbulence of a transfer electric field and resiliency between toner upon a toner layer to be transferred next.

Therefore, not only a monochrome color patch but a color patch in which plural colors of toner is overlapped, that is, the second sample image are formed and the density of the fixed sample image is detected. The details will be described next.

Figure 6:
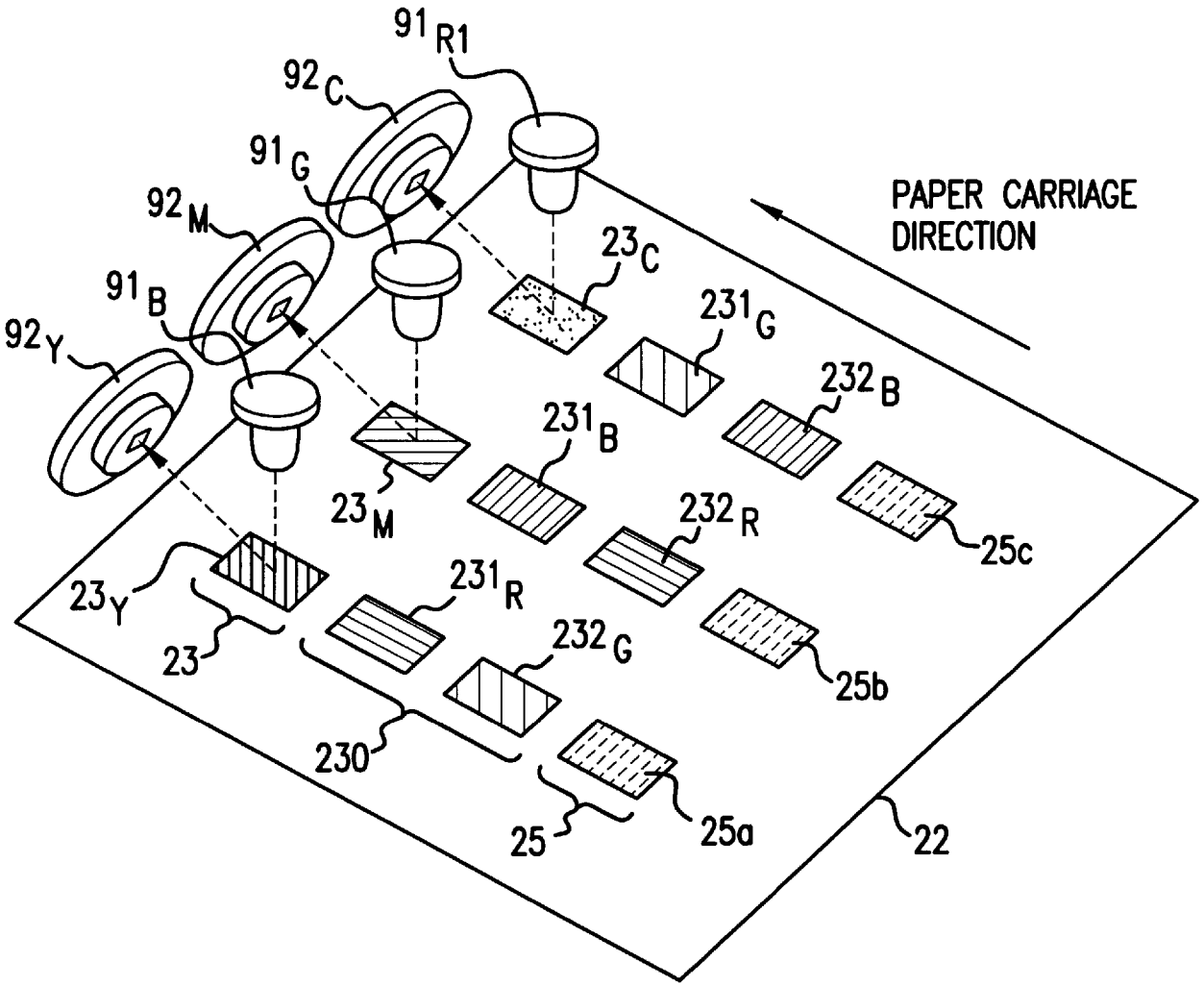
FIG. 6 is an explanatory drawing showing reading in the color patch consisting of each monochrome toner of Y, M and C, each color patch of R, G, and B and a neutral gray patch.

FIG. 6 shows a situation in which color patches, consisting of R, G, and B formed by overlapping toner, and a neutral gray patch are simultaneously read together with color patches respectively consisting of monochrome toner of Y, M, and C. In this case, RGB patches 230 and a neutral gray patch 25 by each toner of Y, M, and C are formed next to each color patch $\mathbf{23}_Y$, $\mathbf{23}_M$ and $\mathbf{23}_C$ of Y, M, and C.

The color patches $\mathbf{23}_Y$, $\mathbf{23}_M$ and $\mathbf{23}_C$ of Y, M, and C are arranged as shown in FIG. 4 and the RGB patches 230 are respectively formed next to the color patches $\mathbf{23}_Y$, $\mathbf{23}_M$, and $\mathbf{23}_C$. The RGB patches 230 consists of six patches: R color patch $\mathbf{231}_R$, B color patch $\mathbf{231}_B$, G color patch $\mathbf{231}_G$, G color patch $\mathbf{232}_G$, R color patch $\mathbf{232}_R$, and B color patch $\mathbf{232}_B$.

The R color patch $\mathbf{231}_R$ is adjacent to the color patch $\mathbf{23}_Y$ and is a patch in which yellow and magenta are overlapped. The B color patch $\mathbf{231}_B$ is adjacent to the color patch $\mathbf{23}_M$ with magenta and cyan overlapped, and the G color patch $\mathbf{231}_G$ is a patch in which cyan and yellow are overlapped and is adjacent to the color patch $\mathbf{23}_C$. The G color patch $\mathbf{232}_G$ is provided next to the R color patch $\mathbf{231}_R$ 1with yellow and cyan overlapped, the R color patch $\mathbf{232}_R$ is provided next to the B color patch $\mathbf{231}_B$ with magenta and yellow overlapped and the B color patch $\mathbf{232}_B$ is provided next to the G color patch $\mathbf{231}_G$ with cyan and magenta overlapped.

A gray patch 25*a* is arranged in the row of the color patch $\mathbf{23}_Y$. Similarly, a gray patch 25*b* is arranged in the row of the color patch $\mathbf{23}_M$ and a gray patch 25*c* is arranged in the row of the color patch $\mathbf{23}_C$.

Figure 7A:
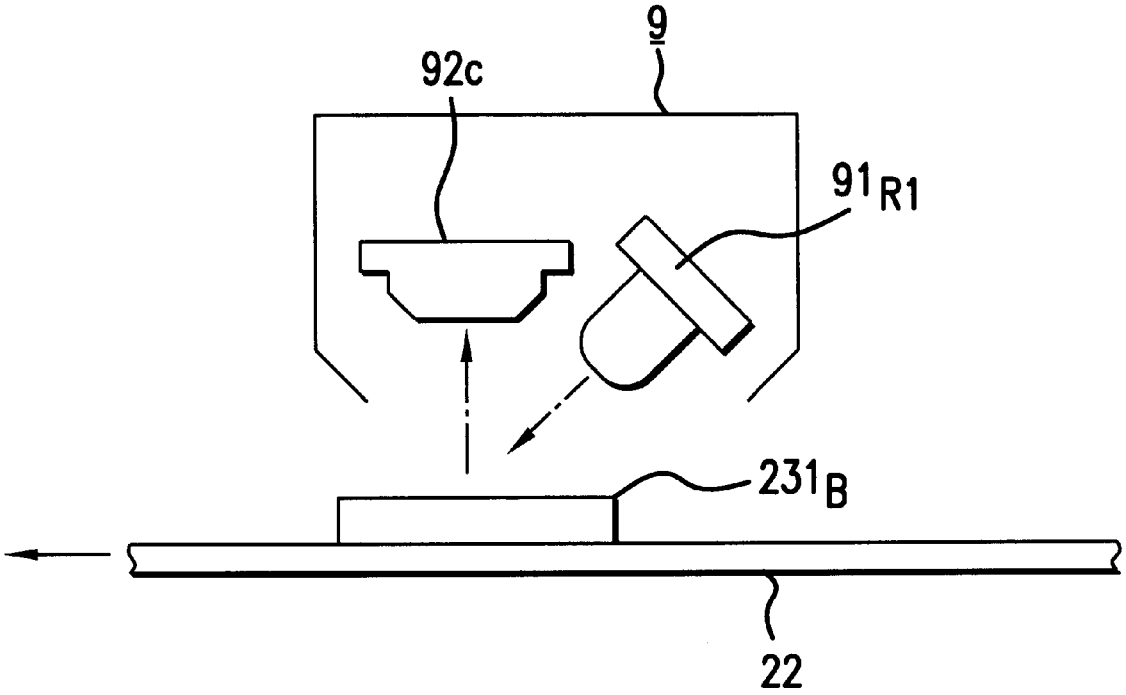
FIGS. 7(*a*)–7(*b*) are explanatory drawings for explaining detecting density in a color patch in case plural toner colors are overlapped.
Figure 7B:
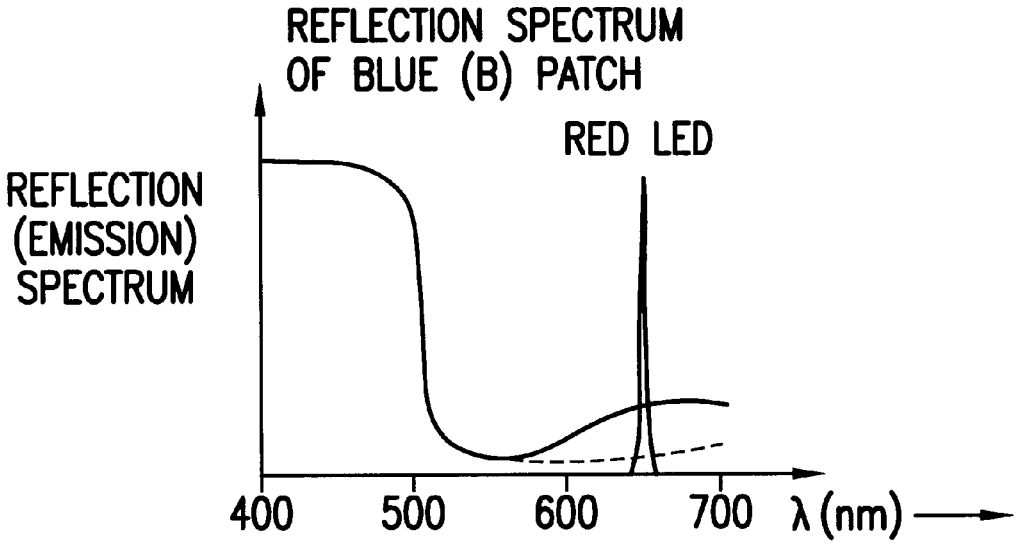

FIGS. 7(*a*) and 7(*b*) are explanatory drawings for explaining the detection of each density in a color patch in which case plural toner colors are overlapped. A case in which each density in the blue (B) color patch $\mathbf{231}_B$ in which cyan and magenta are overlapped is detected will be described below. As is clear from the description of FIG. 1, cyan toner is transferred on magenta toner. As for a cyan component in the B color patch $\mathbf{231}_B$, an image shall be formed by exposure and bias voltage equal to a case of only cyan. If a process after development, that is, a transfer process, is ideally executed, the reflection spectrum of cyan in the B color patch $\mathbf{231}_B$ should show the similar tendency as in FIG. 5(*c*) as shown by a dotted line showing the characteristic in FIG. 7(*b*). However, actually, a transfer efficiency is reduced by the effect of the already transferred magenta toner, the quantity in which the next transferred cyan toner adheres decreases, and the actual reflection spectrum of cyan is at a level shown by a full line in FIG. 7(*b*). In other words, the above reflection spectrum shows that as the density of cyan is low, the absorbed quantity of red light decreases and the reflected light increases.

Detection by the fixed image density sensor 9 is executed after a fixing process and as toner in the B color patch $\mathbf{231}_B$ adheres on the surface of paper with cyan and magenta fully mixed by fixing, only the density of cyan can be precisely detected based upon reflection spectrum by radiating red light (the characteristic of emission shown in FIG. 5(*c*)) which is visible radiation on the B color patch $\mathbf{231}_B$ from LED $\mathbf{91}_{R1}$.

The output from the fixed image density sensor 9 is fed back to the image density control section 16 and the image output section 11B is controlled so that an optimum image formation condition can be achieved. More specifically, a value detected in the color patch 23 and the target value are compared by the image density control section 16 and further, a difference in transfer efficiency is grasped by comparing the color patch 23 with the RGB patch 230. The control unit 11 executes control for changing an image formation condition according to a difference in the density of toner based upon the result. Thus, a satisfactory image quality of full color image can be obtained. Particularly, a color image which is excellent in gray balance can be obtained.

As described above, the variation of transfer efficiency is not always fixed and it greatly differs depending upon environment such as temperature and humidity, the aging of a photoconductive drum, toner and others, the density of toner in a developing machine, and the like. Therefore, controllability of the image quality of a full color image is not satisfactory and particularly, it is extremely difficult to acquire neutral gray, that is, gray balance reproduced by overlapping three primary colors by each toner of Y, M, and C.

According to the present invention, as differences among each toner in transfer efficiency can be known by reading the density of each color in color patches consisting of monochrome toner and in color patches consisting of plural colors respectively formed as a sample image, comparing them with the target value of fixed image density, and comparing the density of each color patch consisting of monochrome toner with that of the corresponding color in each color patch consisting of plural colors, satisfactory control can be also executed upon the quality of a full color image formed by overlapping plural types of toner.

In the present invention, in addition to control upon a charger, a developing machine, a transfer printing machine, etc., the conversion of a color may be also controlled. In this case, the variation of detected transfer efficiency is fed back to the color conversion processing section 18 via the color conversion control section 15 and a conversion coefficient of a color conversion matrix is corrected. Thus, a color image which is excellent in gray balance and the reproducibility of a color in a color gamut can be obtained.

Figure 8:
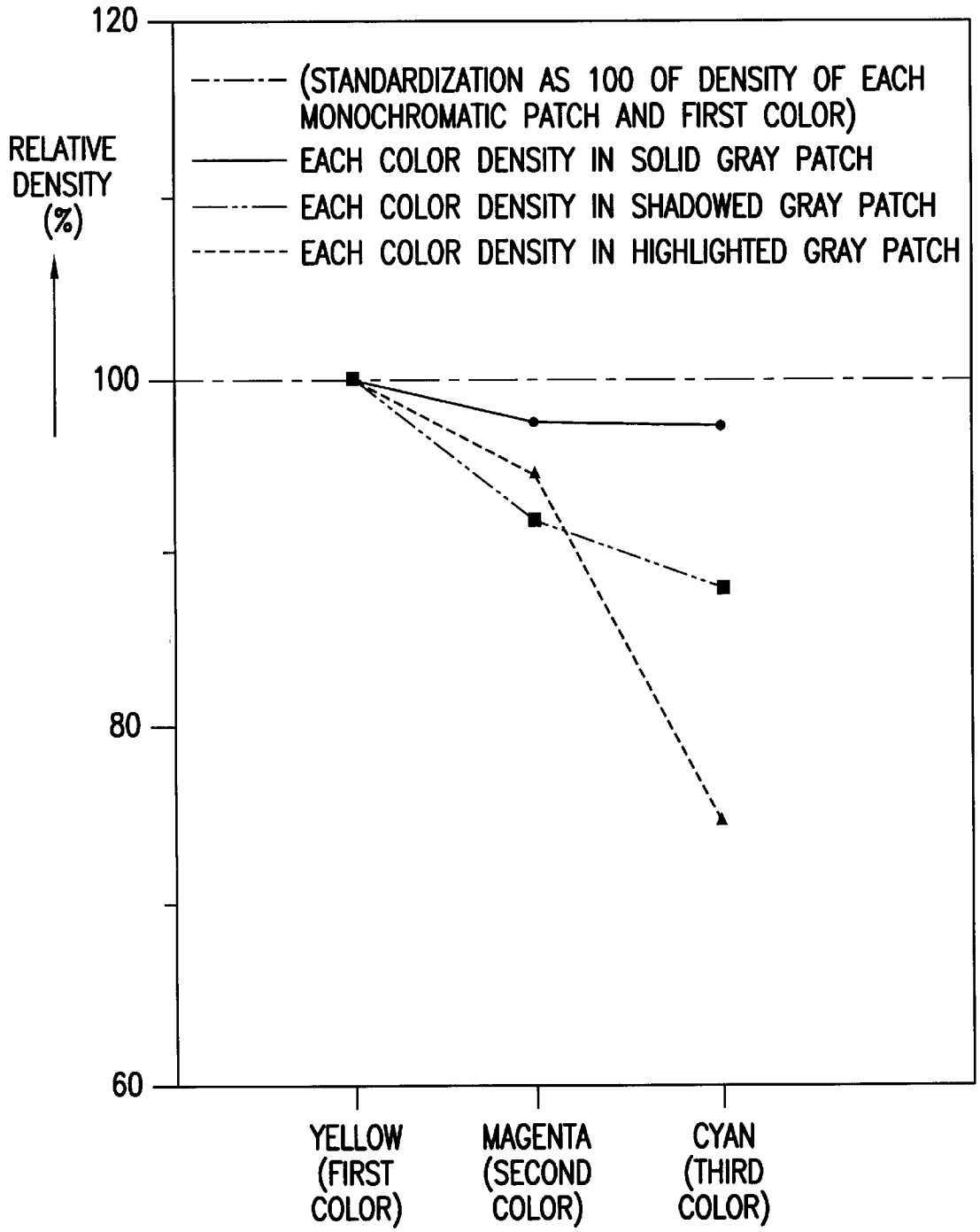
FIG. 8 is a characteristic drawing showing relationship between each density component of Y, M and C in a gray patch consisting of Y, M and C and a transfer order.

FIG. 8 shows a relationship between each density component of Y, M, and C in a YMC gray patch and a transfer order. Density shown in FIG. 8 means relative density standardized based upon the density of each monochrome patch and the density of yellow (Y) which is a first color. As is clear from FIG. 8, the density of toner transferred later is relatively lower. As for cyan, which is transferred third, the lower the density is (in the order of a solid state, a shadowy state and a highlight), the more remarkable the reduction of the density is.

Figure 9A:
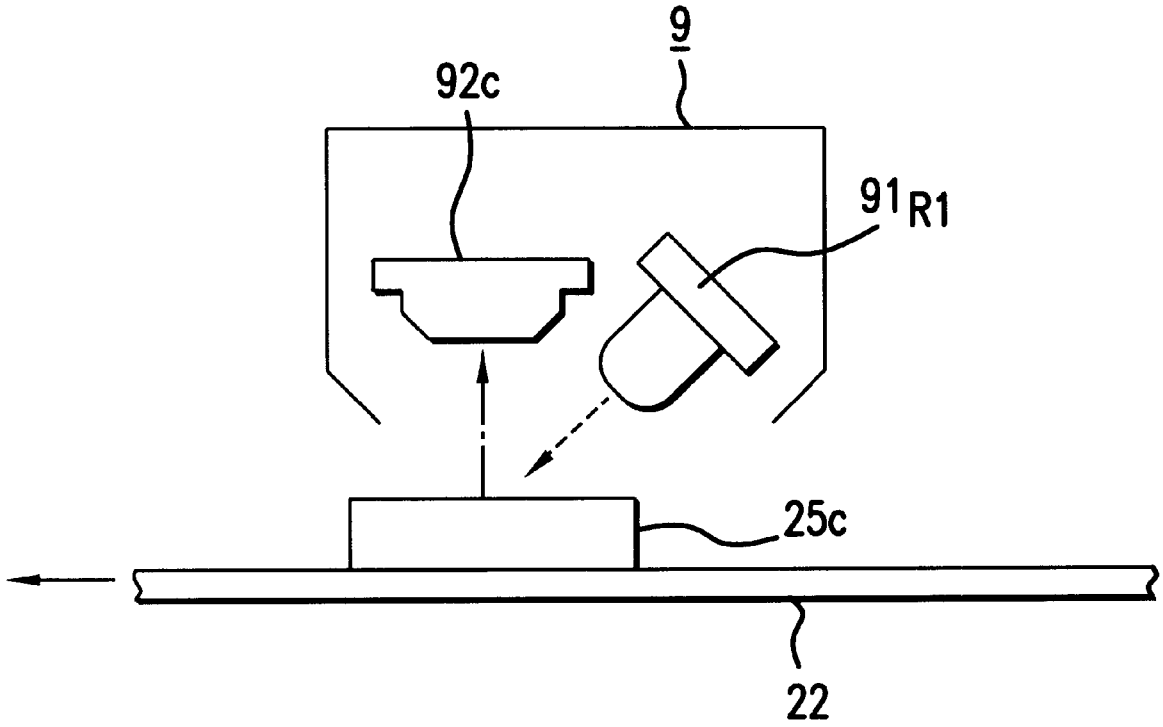
FIGS. 9(*a*)–9(*b*) explanatory drawings showing a case in which the color patch of neutral gray is read.
Figure 9B:
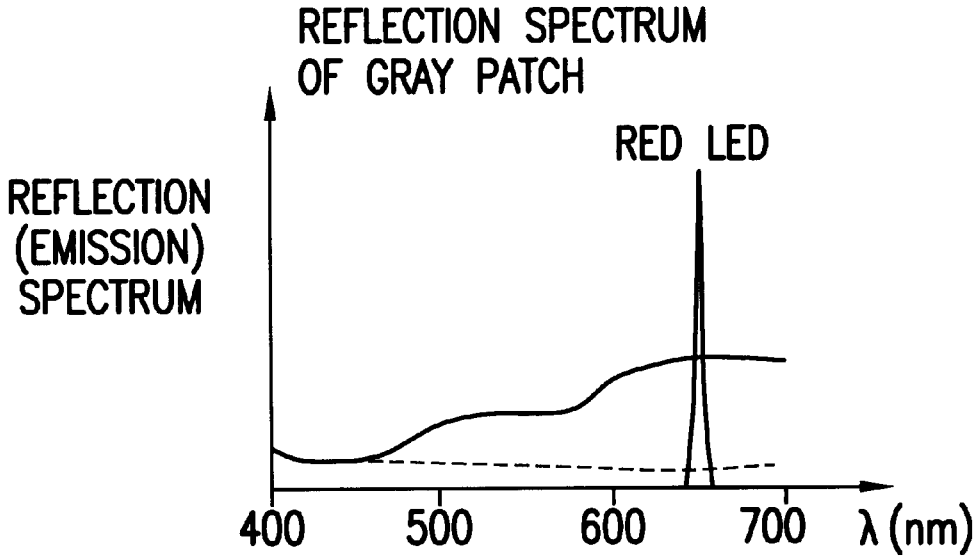

FIGS. 9(*a*) and 9(*b*) are explanatory drawings showing a case in which the color patch 25 of neutral gray is read. As light in overall wavelength is absorbed in a color patch of neutral gray, that is, in a color patch in which each toner of C, M, and Y is overlapped in an equal quantity, the quantity of reflected light is reduced and the reflection spectrum is flat as shown by a dotted line in FIG. 9(*b*). However, when the density of cyan is reduced, the reflection spectrum varies as shown by a full line in FIG. 9(*b*). This is because the quantity in which cyan toner transferred latest adheres decreases by the reduction of transfer efficiency by the effect of yellow (Y) toner and magenta (M) toner both of which already adhere. As a result, the color patch 25 is not completely neutral gray but reddish (R) gray. If light is radiated on the gray color patch from red LED, only a cyan component in the reflection spectrum can be identified and only the density of cyan can be precisely detected. The output acquired as described above of the fixed image density sensor 9 is sent to the image density control section 16 as in the case of the color patches 230 of R, G, and B and the same processing as that for the color patches of R, G, and B is executed.

TABLE 1

| Light source | Detected color (transfer order) | Patch color/ Corre-sponding degree (%) | | Control para-meter | Control value | Result (Patch color/ Corre-sponding degree (%)) | |
|---|---|---|---|---|---|---|---|
| Blue LED ($91_B$) | Yellow (1st) | Yellow $23_Y$ | 100% | Expo-sure quantity | ±0% | Yellow | 100% |
| | | Red $231_R$ | 100% | | ±0% | Red | 100% |
| | | Green $232_G$ | 100% | | ±0% | Green | 100% |
| Green LED ($91_C$) | Magenta (2nd) | Gray 25a | 100% | | ±0% | Gray | 100% |
| | | Yellow $23_M$ | 100% | Expo-sure quantity | ±0% | Yellow | 100% |
| | | Blue $231_B$ | 100% | | ±0% | Blue | 100% |
| | | Red $232_R$ | 90% | | +11% | Red | 100% |
| | | Gray 25b | 90% | | +11% | Gray | 100% |
| Red LED ($91_{R1}$) | Cyan (3rd) | Cyan $23_C$ | 100% | Expo-sure quantity | ±0% | Cyan | 100% |
| | | Green $231_G$ | 90% | | +11% | Green | 100% |
| | | Blue $232_B$ | 90% | | +11% | Blue | 100% |
| | | Gray 25c | 80% | | +25% | Gray | 100% |

In the embodiment of the present invention described above, the result shown in Table 1 is obtained by setting the density of a color image to solid printing. As a light source, blue LED $\mathbf{91}_B$, green LED $\mathbf{91}_G$, and red LED $\mathbf{91}_{R1}$ respectively shown in FIG. 6 are used and a color patch is formed according to the transfer order of Y, M, and C shown in FIG. 1. As shown in Table 1, magenta in a red patch $\mathbf{232}_R$ and magenta in the gray patch 25*b* respectively detected by light from green LED $\mathbf{91}_G$ do not reach the target value (100%), and cyan in a green patch $\mathbf{231}_G$, cyan in a blue patch $\mathbf{232}_B$, and cyan in the gray patch 25*c* respectively detected by light from red LED $\mathbf{91}_{R1}$ do not reach the target value. Therefore, if the quantity of exposure by exposure units 1B and 1C as a control parameter is increased by a ratio (%) shown in the item of a control value, the density of any toner can reach the target value. The same result is also obtained in relation to density in a highlighted patch and a shadowy patch. As a control value upon the relative density value of each toner is naturally different depending upon a solid state, a shadowy state, and a highlighted state, the tables of the respective cases are stored in the memory and to correct density, required data is read from the corresponding table.

As an LED is provided with a characteristic excellent in the responsiveness of emission to an input signal, it can be lit according to a pulse. As the deterioration of output by noise and the like can be corrected if reading by a photodiode is executed in synchronization with the lighting according to a pulse, fixed image density can be detected more precisely.

In the above embodiment of the present invention, fixed image density is detected using a sample image, however, fixed image density can be also detected using a normal output image without using a sample image.

Also in the above embodiment, at least one of each manipulated variable such as electrified quantity, the quantity of exposure, developing bias, the rotational speed of,a developing roll, and a toner supply coefficient is controlled, however, another manipulated variable may be also used. Control by the fixed image density sensor 9 may also be utilized for control other than for image density control, for example, for the judgement of a state and/or the display of a warning.

Further, in the above description, feedback control is executed based upon difference between information from the fixed image density sensor 9 and a target value, however, another control method, for example a control method such as fuzzy control, neurocontrol or leaning propulsion type control may also be used.

Also, the conversion coefficient of a color conversion matrix is corrected in color conversion processing by the color conversion processing section 18, however, a method of using control over the scale of each color may be also adopted.

Further, in the above embodiment, in the fixed image density sensor 9, LED and photodiodes are combined, however, a phototube and a photomultiplier may be used in place of LED and a photoconductor, and a phototransistor may be used in place of a photodiode. An optical system for converging light may also be provided in an optical path. Further, light reflected on the surface of a patch is received and detected, however, transmitted light may be also detected.

As for the transfer method of the color image formation apparatus, an electrostatic image transfer method is used, however, the present invention can also be applied to a color image formation apparatus according to a melting thermal transfer method.

As described above, according to the color image formation apparatus of the present invention, since a monochrome color patch of first color toner and a color patch consisting of plural colors in which the first color toner is overlapped on second color toner different from the first color toner are formed, the density of the first color toner in the monochrome color patch and the density of the first color toner in the color patch consisting of the plural colors are detected by detecting light of wavelength according to the reflection spectrum of the first color toner and the image formation conditions of the first color toner are controlled according to difference between the both density, the variation of transfer efficiency can be precisely detected and a color image which is excellent in gray balance can be formed. Also, as the density of each toner of Y, M, and C is detected by one density sensor, the size of the apparatus and the cost can be reduced. Further, as the toner density of a monochrome color patch is compared with the target value, the density of each color toner of Y, M, and C can be individually and precisely corrected.

What is claimed is:

1. A color image formation apparatus in which a color density of a color image formed under a set formation condition is detected and said formation condition is corrected based upon the color density, comprising:

image formation means for forming said color image according to said formation condition;

detection means for detecting said color density of said color image; and control means for correcting said formation condition based upon said color density detected by said detection means;

said image formation means forming at least one sample image group, each at least one sample image group comprising a first sample image using one of a plurality of color materials for forming said color image independently and a second sample image in which at least two of said plurality of color materials are overlapped;

said detection means comprising at least one light source, each at least one light source radiating one of red, green and blue detecting light on a respective one of the at least one sample image group, and at least one light receiving section for receiving said detecting light that is reflected from the at least one sample image group according to respective color densities of said first and second sample images; and said control means correcting said formation condition based upon a difference in said color density of the corresponding color between said first and second sample images.

2. A color image formation apparatus according to claim 1, wherein said detection means is arranged after a fixing process.

3. A color image formation apparatus according to claim 1, wherein said at least one light source comprises a blue LED for radiating light onto yellow material, a green LED for radiating light onto magenta material and a red LED for radiating light onto cyan material.

4. A color image formation apparatus according to claim 1, wherein said image formation means uses each toner of cyan, magenta and yellow or each toner of cyan, magenta, yellow and black for said plurality of color materials.

5. A color image formation apparatus according to claim 1, wherein:

for each color material, said image formation means comprises a charger for electrifying a photoconductive drum, an exposure unit for exposing said photoconductive drum after electrification and forming an electrostatic latent image, a developing machine for forming a toner image corresponding to said electrostatic latent image by one of said plurality of color materials and transfer means for transferring said toner image onto a transfer medium; and said control means corrects at least one of a bias voltage of said charger, a condition for exposure of said exposure unit, a bias voltage of said developing machine, a toner density of said developing machine and a driving condition of said transfer means based upon said different in color density.

6. A color image formation apparatus according to claim 1, wherein said control means corrects color conversion processing for an input picture signal based upon said difference in color density.

7. A color image formation apparatus according to claim 1, wherein said control means has at least one of a reference picture signal generating section for generating a reference picture signal for forming said first and second sample images and a memory for storing a reference image signal for forming said first and second sample images.

8. A color image formation apparatus according to claim 1, wherein said light source emits said detecting light for radiating said first and second sample images at the amplitude of a pulse.

9. A color image formation apparatus according to claim 1, wherein said control means is provided with detection means for detecting a change of environment and a look-up table every color for specifying a light quantity value in response to a signal showing a difference based upon output from the detection means.

10. A color image formation apparatus according to claim 1, wherein said control means is provided with detection means for detecting a change of environment and a look-up table every color for specifying a developing bias value in response to a signal showing a difference based upon output from the detection means.

11. A color image formation apparatus according to claim 1, wherein said control means is provided with detection means for detecting a change of environment and a look-up table every color for specifying a grid voltage value in response to a signal showing a difference based upon output from the detection means.

12. A color image formation apparatus for detecting a color density of a color image formed under a set formation condition of a color image and correcting said formation condition based upon the color density, comprising:

image formation means for forming said color image under said formation condition;

detection means for detecting said color density of said color image; and control means for correcting said formation condition based upon said color density detected by said detection means, wherein said image formation means forms at least one sample image group comprising a first sample image using at least one of a plurality of color materials for forming a color image independently and a second sample image in which at least two of said color materials are overlapped;

said detection means having at least one light source, each at least one light source radiating one of red, green and blue detecting light on a respective one of the at least one sample image group, and at least one light receiving section for receiving said detecting light that is reflected from the at least one sample image group according to respective color densities of said first and second sample images; and said control means correcting said formation condition based upon a difference between said color density of said first sample image and a target value and also correcting said formation condition based upon a difference in said color density of the corresponding color between said first sample image and said second sample image.

* * * * *